US005580356A

United States Patent [19]

Taylor

[11] Patent Number: 5,580,356

[45] Date of Patent: Dec. 3, 1996

[54] FIBRE TREATMENT METHOD

[75] Inventor: James M. Taylor, Derby, United Kingdom

[73] Assignee: Courtaulds Fibres (Holdings) Limited, London, United Kingdom

[21] Appl. No.: 505,323

[22] PCT Filed: Mar. 9, 1994

[86] PCT No.: PCT/GB94/00461

§ 371 Date: Aug. 17, 1995

§ 102(e) Date: Aug. 17, 1995

[87] PCT Pub. No.: WO94/20656

PCT Pub. Date: Sep. 15, 1994

[30] Foreign Application Priority Data

Mar. 10, 1993 [GB] United Kingdom ..... 9304887

[51] Int. Cl.[6] ..... D01F 11/02; D01F 2/00

[52] U.S. Cl. ..... 8/116.1; 8/185; 8/186; 8/195; 8/196; 8/120; 8/184; 8/121; 162/157.7

[58] Field of Search ..... 8/116.1, 185, 186, 8/195, 196, 120, 184, 121, 116.4; 162/157.7, 157.6

[56] References Cited

U.S. PATENT DOCUMENTS

| | | |
|---|---|---|
| 2,394,306 | 2/1946 | Hentrich et al. . |
| 2,892,674 | 6/1959 | Sause et al. . |
| 2,971,815 | 2/1961 | Bullock et al. . |
| 3,294,778 | 12/1966 | Randall et al. . |
| 3,383,443 | 5/1968 | Leahy et al. . |
| 3,400,127 | 9/1968 | Tesoro et al. . |
| 3,461,052 | 8/1969 | Restaino et al. . |
| 3,574,522 | 4/1971 | Rowland et al. . |

(List continued on next page.)

FOREIGN PATENT DOCUMENTS

| | | |
|---|---|---|
| 40668/78 | 4/1980 | Australia . |
| 118983 | 9/1984 | European Pat. Off. . |
| 174794 | 3/1986 | European Pat. Off. . |
| 437816 | 7/1991 | European Pat. Off. . |
| 466648 | 1/1992 | European Pat. Off. . |
| 538977 | 4/1993 | European Pat. Off. . |
| 1148892 | 12/1957 | France . |
| 1158775 | 6/1958 | France . |
| 1565248 | 4/1969 | France . |
| 1576514 | 8/1969 | France . |
| 2108069 | 5/1972 | France . |
| 2273091 | 3/1974 | France . |
| 2407280 | 5/1979 | France . |
| 2450293 | 9/1980 | France . |
| 1444127 | 9/1969 | Germany . |
| 1928814 | 12/1970 | Germany . |
| 1930768 | 1/1971 | Germany . |
| 2111038 | 9/1972 | Germany . |
| 2118224 | 11/1972 | Germany . |
| 2242939 | 3/1973 | Germany . |
| 2209255 | 9/1973 | Germany . |
| 2249321 | 5/1974 | Germany . |

(List continued on next page.)

OTHER PUBLICATIONS

M. Dube et al, "Precipitation and Crystallization of Cellulose from Amine Oxide Solutions" in *Proceedings of the Technical Association of the Pulp and Paper Industry, 1983 International Dissolving and Specialty Pulps Conference,* TAPPI Press, pp. 111–119 (1983) (Month Unknown).

M. Hurwitz et al, "Dialdehydes as Cotton Cellulose Cross–Linkers", Textile Research Journal, 28(3):257–262. (Mar., 1958).

H. Nemec, "Fibrillation of Cellulosic Materials–Can Previous Literature Offer a Solution?", Lenzinger Berichte, 9:69–72 (Sep., 1994).

"Radiopaque Polymers to Safety", Encyclopedia of Polymer Science and Engineering, vol. 14, pp. 45–46, 57–59, John Wiley & Sons, Inc. (1988) (Month Unknown).

"Styrene Polymers to Toys", Encyclopedia of Polymer Science and Engineering, vol. 16, pp. 16 and 685, John Wiley & Sons, Inc. (1989) (Month Unknown).

R. Moncrieff, "Man–Made Fibres", 6th Edition, 6 pages 900–925 (1975) (Month Unknown).

"Textile Resins", in Encyclopedia of Polymer Science and Technology , 16:682–699 (1989) (Month Unknown).

"Dyeing" in Encyclopedia of Polymer Science and Engineering, 5: 226–245 (1986) (Month Unknown).

S. Kulkami et al, "Textile Dyeing Operations", pp. 2–3, 84–105 (1986) (Month Unknown).

"Dyes, Reactive" in Kirk–Othmer, Encyclopedia of Chemical Technology, 3rd edition, 8:374–385 (1979) (Month Unknown).

R. Rosenthal, "Genesis Fiber Developed by Courtaulds", Nonwovens Ind., Paperchem No. 57–06976 (Abstract) (Aug., 1986).

"New Generation of Cellulose Fibers", Melliand Textilberichte/ International Textile Reports, Textile Technol. Dig. No. 03135/91 (Abstract) (Feb., 1991).

Lenzing Opens Solvent–Spinning Line for Cellulose Fibres", Nonwovens Rep. Int., Pira Abstract No. 07–91–00562 (Abstract) (Dec., 1990).

J. Marsh, "An Introduction to Textile Finishing", 2d ed., Chapman and Hall Ltd. (London, 1966), p. 1 (Month Unknown).

Ullmann's Encyclopedia of Industrial Chemistry, Fifth, Completely Revised Edition, vol. A10: "Ethanolamines to Fibers, 4. Synthetic Organic", Section 4.2.2. Washing and Finishing, VCH (Weinheim, 1987), p. 558 (Month Unknown).

R. Moncrieff, "Man–Made Fibres", 5th ed., p. 211 (1970) (Month Unknown).

(List continued on next page.)

*Primary Examiner*—Prince Willis, Jr.
*Assistant Examiner*—Alan D. Diamond
*Attorney, Agent, or Firm*—Howson and Howson

[57] ABSTRACT

The fibrillation tendency of solvent-spun cellulose fibre is reduced by treating the fibre with a cross-linking agent and a flexible linear polymer with terminal functional groups, for example polyethylene glycol (PEG) of molecular weight 300 to 600. The fibre may be treated in never-dried or in fabric form.

17 Claims, No Drawings

U.S. PATENT DOCUMENTS

| | | | |
|---|---|---|---|
| 3,663,159 | 5/1972 | Gordon . | |
| 3,839,207 | 10/1974 | Weil . | |
| 3,849,169 | 11/1974 | Cicione et al. . | |
| 3,849,409 | 11/1974 | Weil . | |
| 3,883,523 | 5/1975 | Parton . | |
| 3,954,405 | 5/1976 | North et al. | 8/185 |
| 3,960,983 | 6/1976 | Blank | 525/496 |
| 4,090,844 | 5/1978 | Rowland . | |
| 4,246,221 | 1/1981 | McCorsley . | |
| 4,268,266 | 5/1981 | Hendricks . | |
| 4,283,196 | 8/1981 | Wenghoefer . | |
| 4,336,023 | 6/1982 | Warburton . | |
| 4,371,517 | 2/1983 | Vanlerberghe . | |
| 4,416,698 | 11/1983 | McCorsley . | |
| 4,443,355 | 4/1984 | Murata et al. . | |
| 4,483,689 | 11/1984 | Welch . | |
| 4,502,866 | 3/1985 | Brenneisen . | |
| 4,563,189 | 1/1986 | Lewis . | |
| 4,629,470 | 12/1986 | Harper, Jr. | 8/185 |
| 4,659,595 | 4/1987 | Walker et al. . | |
| 4,743,267 | 5/1988 | Dyer . | |
| 4,780,102 | 10/1988 | Harper, Jr. . | |
| 4,880,430 | 11/1989 | Schleusener | 8/196 |
| 4,880,431 | 11/1989 | Yokogawa et al. . | |
| 4,908,097 | 3/1990 | Box | 162/9 |
| 4,971,708 | 11/1990 | Lee | 252/8.6 |
| 4,999,149 | 3/1991 | Chen . | |
| 5,085,668 | 2/1992 | Pelster et al. . | |
| 5,131,917 | 7/1992 | Miyamoto et al. . | |
| 5,310,424 | 5/1994 | Taylor . | |
| 5,403,530 | 4/1995 | Taylor . | |
| 5,445,652 | 8/1990 | Connell et al. | 8/196 |

FOREIGN PATENT DOCUMENTS

| | | |
|---|---|---|
| 2554790 | 7/1976 | Germany . |
| 2558163 | 7/1976 | Germany . |
| 2551410 | 5/1977 | Germany . |
| 236581 | 6/1986 | Germany . |
| 48-015234 | 5/1973 | Japan . |
| 48-092668 | 12/1973 | Japan . |
| 49-001870 | 1/1974 | Japan . |
| 49-080392 | 8/1974 | Japan . |
| 50-017593 | 6/1975 | Japan . |
| 50-112598 | 9/1975 | Japan . |
| 50-112599 | 9/1975 | Japan . |
| 51-035786 | 3/1976 | Japan . |
| 52-070187 | 6/1977 | Japan . |
| 52-033718 | 8/1977 | Japan . |
| 52-111922 | 9/1977 | Japan . |
| 52-039479 | 10/1977 | Japan . |
| 52-141843 | 11/1977 | Japan . |
| 53-035017 | 4/1978 | Japan . |
| 53-078377 | 7/1978 | Japan . |
| 53-122880 | 10/1978 | Japan . |
| 55-023093 | 6/1980 | Japan . |
| 58-87367 | 5/1983 | Japan . |
| 62-210054 | 9/1987 | Japan . |
| 62-044077 | 9/1987 | Japan . |
| 62-057744 | 12/1987 | Japan . |
| 1-000505 | 1/1989 | Japan . |
| 1271238 | 10/1989 | Japan . |
| 1297430 | 11/1989 | Japan . |
| 3197128 | 8/1991 | Japan . |
| 4241179 | 8/1992 | Japan . |
| 4218502 | 8/1992 | Japan . |
| 4298516 | 10/1992 | Japan . |
| 71100 | 9/1976 | Poland . |
| 543484 | 12/1973 | Switzerland . |
| 465384 | 10/1975 | U.S.S.R. . |
| 576270 | 3/1946 | United Kingdom . |
| 734974 | 8/1955 | United Kingdom . |
| 810352 | 3/1959 | United Kingdom . |
| 878655 | 10/1961 | United Kingdom . |
| 936399 | 9/1963 | United Kingdom . |
| 950073 | 2/1964 | United Kingdom . |
| 953171 | 3/1964 | United Kingdom . |
| 1142428 | 2/1969 | United Kingdom . |
| 1271518 | 4/1972 | United Kingdom . |
| 1354406 | 5/1974 | United Kingdom . |
| 2007147 | 5/1979 | United Kingdom . |
| 2043525 | 10/1980 | United Kingdom . |
| 2103639 | 11/1984 | United Kingdom . |
| W081/03274 | 11/1981 | WIPO . |
| W092/07124 | 4/1992 | WIPO . |
| W092/19807 | 11/1992 | WIPO . |
| W094/09191 | 4/1994 | WIPO . |
| W094/20656 | 9/1994 | WIPO . |

OTHER PUBLICATIONS

"Man–Made Fibers Science and Technology", vol. 2, p. 33, Interscience Publishers (1968) (Month Unknown).

E. Flick, "Textile Finishing Chemicals, An Industrial Guide", p. 372 (Mar., 1990).

S. Anand et al, "The Dimensional Properties of Single–Jersey Loop–Pile Fabrics, Part II: Studies of Fabrics with Textured Continous–filament Yarns in the Ground Structure", J. Text. Inst., 5:349 (1987) (Month Unknown).

H. Nasr et al, "Wood Blends with Improved Dyeability and Stain–release Properties Through Gamma Ray Induced Grafting", Kolor. Ert., 23(2–3):55–64 (1981) (Abstract only) (Month Unknown).

A. Hebeish et al, "Chemical Modification of Cotton Through Reaction with Alkoxy Adducts of Acrylamide and Hexahydro–1,3,5–triacryloyl–s–triazine in Nonaqueous Medium", Angew. Makromol. Chem., 91:77–97 (1980) (Abstract only) (Month Unknown).

M. El–Kashouti et al, "Utilization of Hexahydro–1, 3, 5–triacryloyl–s–triazine in Cotton Printing", Cellul. Chem. Technol., 12(2):223–229 (1978) (Abstract only) (Month Unknown).

S. Rowland et al, "Polymerization–crosslinking of N–methylolacrylamide in Cotton Fabric", Text. Res. J., 48(2) :73–80 (1978) (Abstract only) (Month Unknown).

M. Solarz et al, "Wrinkle–resistant Finishing of Cellulose Fabrics in an Alkaline Medium with Simultaneous Dyeing with Acid Dyes", Przegl. Wlok., 31(1):28–31 (1977) (Abstract only) (Month Unknown).

M. Solarz, "Modification of Cellulose Fibers with N, N'–methylenebisacrylamide", Przegl. Wlok., 30(11–12) :546–549 (1976) (Abstract only) (Month Unknown).

J. Arthur, "Photofinishing for Cotton Textiles", U.S. , Agric. Res. Serv., South. Reg., ARS–S–64, 6–7 (1975) (Abstract only) (Month Unknown).

M. Kamel et al, "Creation of Reactive Centers for Cotton, VII., Mechanism of Reaction of Cotton with Hexahydro–1, 3, 5–triacryloyl–s–triazine", Text. Res. J., 45(11) :800–804 (1975) (Abstract only) (Month Unknown).

M. Kamel et al, "Creaction of Reaction Centers on Cotton, III., Synthesis of Some New Methylolacrylamide Derivatives, Kolor. Ert., 17(7–8):217–224 (1975) (Abstract only) (Month Unknown).

J. Bogdanski, "Binding of Cellulose Xanthation by–products with Hexahydro–1, 3, 5–tracryloyltriazine", Zesz. Nauk. –Akad. Ekon. Poznaniu, Ser. 1, 58:143–146 (1974) (Abstract only) (Month Unknown).

H. Nasr, "Radiation Modification of Cotton Fabrics, II., Catalytic Effect of Grafted Acids", Text. Res. J., 43(10):607–608 (1973) (Abstract only) (Month Unknown).
A. Wawrzyniak, "Dyeing Cellulose Fibers with azo Dyes Coupled to the Fiber Through a Reactive Intermediate", Przegl. Wlok., 26(6):337–347 (1972) (Abstract only) (Month Unknown).
H. Nasr, "Radiation Modification of Cotton Fabrics, I., Crosslinking Cotton Using Multifunctional Monomers", Text. Res. J., 42(8):497–499 (1972) (Abstract only) (Month Unknown).
A. Wawrzyniak et al, "Nature of the Chemical Reaction Between an Anionic Dye and Cellulose in the Presence of a Free Reactive System", Przegl. Wlok., 25(12):647–653 (1971) (Abstract only) (Month Unknown).
M. Kamel et al, "Dye Fixation Using Hexahydro–1, 3, 5–triacryloyl–s–triazine", Amer. Dyest. Rep., 60(3):33–34, 38, 40, 42 (1971) (Abstract only) (Month Unknown).
G. Valk et al, "Creation of Reactive Centers on Cellulose Using Hexahydro–1, 3, 5–triacryloyl–s–triazine", Text. Res. J., 41(4):364 (1971) (Abstract only) (Month unknown).
F. Schlaeppi et al, "Fixation of Dyes by High Energy Irradiation", Text. Chem. Color., 2(24):414–424 (1970) (Abstract only) (Month Unknown).
G. Valk et al, "Analysis of High–Grade Finishes, 7., Chemical Detection of the Cross–linking of Cotton with N–acrylamide Derivatives", Melliand Textilber., 51(6):714–719 (1970) (Abstract only) (Month Unknown).
S. Rowland et al, "Reaction of Activated Vinyl Compounds with Cotton Cellulose via Internal Catalysis", J. Appl. Polym. Sci., 14(2):441–452 (1970) (Abstract only) (Month Unknown).
M. Chekalin et al. "Fixation of Dyes Containing Labile Hydrogen on Cotton Fabrics by Means of Polyfunctional Compounds", Tekst. Prom. (Moscow), 28(9):40–43 (1968) (Abstract only) (Month Unknown).
R. Harper, "Crosslinking, Grafting and Dyeing: Finishing for Added Properties", Textile Chemist and Colorist, 23(11): 15–20 (Nov., 1991).
"Sulfonation and Sulfation to Thorium and Thorium Compounds" in Kirk–Othmer, Encyclopedia of Chemical Technology, 3rd edition, 22:769–790 (1983) (Month Unknown).
H. Petersen, "The Chemistry of Crease–Resistant Crosslinking Agents", Rev. Prog. Coloration, 17:7–22 (1987) (Month Unknown).

FIBRE TREATMENT METHOD

FIELD OF THE INVENTION

This application is a 371 of PCT/GB94/00461 filed Mar. 9, 1994 and published as WO94/20656 Sep. 15, 1994.

This invention is concerned with a method of reducing the fibrillation tendency of solvent-spun cellulose fibre.

BACKGROUND ART

It is known that cellulose fibre can be made by extrusion of a solution of cellulose in a suitable solvent into a coagulating bath. One example of such a process is described in U.S. Pat. No 4,246,221, the contents of which are incorporated herein by way of reference. Cellulose is dissolved in a solvent such as a tertiary amine N-oxide, for example N-methylmorpholine N-oxide. The resulting solution is extruded through a suitable die to produce filaments, which are coagulated, washed in water to remove the solvent and dried. The filaments are generally cut into short lengths at some stage after coagulation to form staple fibre. This process of extrusion and coagulation is referred to as "solvent-spinning", and the cellulose fibre produced thereby is referred to as "solvent-spun" cellulose fibre. It is also known that cellulose fibre can be made by extrusion of a solution of a cellulose derivative into a regenerating and coagulating bath. One example of such a process is the viscose process, in which the cellulose derivative is cellulose xanthate. Both such types of process are examples of wet-spinning processes. Solvent-spinning has a number of advantages over other known processes for the manufacture of cellulose fibre such as the viscose process, for example reduced environmental emissions.

Fibre may exhibit a tendency to fibrillate, particularly when subjected to mechanical stress in the wet state. Fibrillation occurs when fibre structure breaks down in the longitudinal direction so that fine fibrils become partially detached from the fibre, giving a hairy appearance to the fibre and to fabric containing it, for example woven or knitted fabric. Dyed fabric containing fibrillated fibre tends to have a "frosted" appearance, which may be aesthetically undesirable. Such fibrillation is believed to be caused by mechanical abrasion of the fibres during treatment in a wet and swollen state. Wet treatment processes such as dyeing processes inevitably subject fibres to mechanical abrasion. Higher temperatures and longer times of treatment generally tend to produce greater degrees of fibrillation. Solvent-spun cellulose fibre appears to be particularly sensitive to such abrasion and is consequently often found to be more susceptible to fibrillation than other types of cellulose fibre. In particular, cotton has an inherently very low fibrillation tendency.

It has been known for many years to treat cellulose fibre and in particular fabric with a crosslinking agent to improve its crease resistance, as described for example in Kirk-Othmer's Encyclopaedia of Chemical Technology, third edition, Volume 22 (1983), Wiley-Interscience, in an article entitled "Textiles (Finishing)" at pages 769–790, and by H. Petersen in Rev. Prog. Coloration, Vol 17 (1987), pages 7–22. Crosslinking agents may sometimes be referred to by other names, for example crosslinking resins, chemical finishing agents and resin finishing agents. Crosslinking agents are small molecules containing a plurality of functional groups capable of reacting with the hydroxyl groups in cellulose to form crosslinks. One class of crosslinking agents consists of the N-methylol resins, that is to say small molecules containing two or more N-hydroxymethyl or N-alkoxymethyl, in particular N-methoxymethyl, groups. N-methylol resins are generally used in conjunction with acid catalysts chosen to improve crosslinking performance. In a typical process, a solution containing about 5–9% by weight N-methylol resin crosslinking agent and 0.4–3.5% by weight acid catalyst is padded onto dry cellulosic fabric to give 60–100% by weight wet pickup, after which the wetted fabric is dried and heated to cure and fix the crosslinking agent. In general, more than 50%, often 75%, of the crosslinking agent becomes fixed to the cellulose. It is known that crease-resistant finishing treatments embrittle cellulose fibre and fabric with a consequent loss of abrasion resistance, tensile strength and tear strength. A balance must be struck between improvement in crease resistance and reduction in such other mechanical properties. It is also known that such treatments reduce dyeability.

U.S. Pat. No. 4,780,102 describes a process for dyeing a smooth-dry cellulosic fabric which comprises padding the cellulosic fabric with an aqueous finishing solution comprising sufficient concentrations of N-methylol crosslinking agent, acid catalyst and polyethylene glycol (PEG) in order to impart smooth-dry and dye receptivity properties to the fabric; drying and curing the fabric for sufficient time and at sufficient temperature to interact the components of the finish with the fabric; and dyeing the fabric with a cellulose dye. The cellulosic fabric is preferably a cotton fabric. The pad bath typically contains by weight 5–10% crosslinking agent, 0.7–0.8% zinc nitrate hexahydrate and 10–20% PEG. Smooth-dry ratings begin to drop off substantially with PEG molecular weights of 600 or less, and on this basis PEG of molecular weight 600–1450 is preferred depending on the level of smooth-dry performance desired.

DISCLOSURE OF THE INVENTION

A method according to the present invention for reducing the fibrillation tendency of solvent-spun cellulose fibre is characterised in that it includes the step of contacting the fibre with:

(a) a flexible linear polymer having terminal functional groups; and (b) a crosslinking agent reactive with cellulose and with said terminal functional groups.

The method of the invention may be performed on never-dried fibre or on fabric, for example woven or knitted fabric, containing the fibre. Never-dried fibre is defined as fibre produced in a wet-spinning process, which has been coagulated and washed but which has not been dried.

The crosslinking agent may in general be any of those known in the art for crease-resistant finishing of cellulose. The crosslinking agent is preferably an agent classed as a low-formaldehyde or zero-formaldehyde crosslinking agent, further preferably an agent classed as a zero-formaldehyde agent when the method of the invention is carried out on fabric. One class of low-formaldehyde crosslinking agents consists of the N-methylol resins. Examples of suitable N-methylol resins are those described in the abovementioned articles in Kirk-Othmer and by Petersen. Examples of such resins include 1,3-dimethylolethyleneurea (DMEU), 1,3-dimethylolpropyleneurea (DMPU) and 4,5-dihydroxy-1,3-dimethylolethyleneurea (DHDMEU). Other examples include compounds based on urones, triazinones and carbamates. Another example of a preferred class of crosslinking agents consists of compounds based on 1,3-dialkyl-4,5-dihydroxy(alkoxy)ethyleneurea, for example 1,3-dimethyl-4,5-dihydroxyethyleneurea. A further example of a suitable crosslinking agent is melamine. Yet another example of a suitable crosslinking agent is butanetetracarboxylic acid (BTCA).

It is known that crosslinking agents for crease-resistant finishing of cellulose are generally used in conjunction with a catalyst, commonly an acid catalyst. The method of the invention preferably utilises such a catalyst when recommended for use with the chosen crosslinking agent. For example, N-methylol resins and 1,3-dialkyl-4,5-dihydroxy-(alkoxy)ethyleneureas are preferably used in conjunction with an acid catalyst, for example an organic acid such as acetic acid or a latent acid such as an ammonium salt, amine salt or metal salt, e.g. zinc nitrate or magnesium chloride. Mixed catalyst systems may be used.

The flexible linear polymer is preferably a wholly aliphatic polymer. The backbone of the flexible linear polymer is preferably unbranched. The flexible linear polymer preferably contains no functional groups reactive with cellulose or with the crosslinking agent other than the terminal functional groups. The terminal functional groups are preferably hydroxyl groups, although other types of groups such as amino groups may also be suitable in some cases. Preferred types of flexible linear polymer include polymerised glycols such as polypropylene glycol (PPG) and in particular polyethylene glycol (PEG). Amine-tipped derivatives of such polymerised glycols may be used.

It will be understood that such flexible linear polymers are generally mixtures of molecules having a range of chain lengths and are characterised in terms of their average molecular weight and chain length. The flexible linear polymer is capable of reacting through its functional groups to provide a linear chain corresponding to the polymer backbone, preferably containing on average about 5 to 150 atoms, more preferably about 10 to 100 atoms, further preferably about 20 to 40 atoms. A preferred example of a flexible linear polymer for use on never-dried fibre is PEG having average molecular weight in the range 100 to 2000, more preferably 200 to 1500, further preferably 300 to 600. In general, use on never-dried fibre of a flexible linear polymer with a backbone shorter than about 5 atoms imparts good fibrillation resistance but an unacceptable reduction in dyeability, whereas use of a flexible linear polymer with a backbone longer than about 150 atoms imparts little reduction in dyeability but only a small improvement in fibrillation resistance. A preferred example of a flexible linear polymer for use on fabric is PEG having average molecular weight in the range 300 to 400. It has been found that fabrics treated with PEG of this molecular weight range exhibit good resistance to fibrillation and good dyeability, whereas fabrics treated with PEG of molecular weight outside this range may possess good resistance to fibrillation but in general exhibit reduced dyeability.

The crosslinking agent, flexible linear polymer and any catalyst are preferably contacted with the fibre from solution, preferably an aqueous solution. Polymerised glycols such as PEG and PPG are generally soluble in water.

The solution may be applied to never-dried fibre in known types of ways, for example the solution may be padded on to the never-dried fibre or the never-dried fibre may be passed through a treatment bath of the solution. The never-dried fibre may have a moisture content of about 45–55%, often around 50%, by weight, after contacting with the solution. Application of the solution to the never-dried fibre may be carried out in such a way that part or substantially all of the water in the never-dried fibre is replaced by the solution. The never-dried fibre may be in tow or staple form. The solution may contain 0.2 to 15%, preferably 0.5 to 10%, more preferably 0.5 to 5%, by weight crosslinking agent (expressed on a 100% activity basis). The solution preferably contains 0.5 to 5% by weight flexible linear polymer. When a catalyst is used, the solution may contain 0.1 to 5%, preferably 0.25 to 2.5%, by weight catalyst. The solution may contain one or more additional substances, for example a soft finish for the fibre. It is an advantage of the method of the invention as applied to never-dried fibre that it can be combined with another treatment step, such as the application of soft finish.

The treated wet never-dried fibre preferably contains 0.2 to 5%, more preferably 0.5 to 2%, by weight crosslinking agent calculated on weight of cellulose. The treated wet never-dried fibre preferably contains 0.5 to 3% by weight flexible linear polymer calculated on weight of cellulose.

The solution may be applied to fabric in known types of ways, for example the solution may be padded onto the fabric or the fabric may be passed through a treatment bath of the solution. The solution may contain 2.5 to 10%, preferably to 7.5%, by weight crosslinking agent (expressed on a 100% activity basis). The solution may contain 5 to 20%, preferably 10 to 15%, by weight flexible linear polymer. When a catalyst is used the solution may contain 0.1 to 5%, preferably 0.25 to 2.5%, by weight catalyst. It has remarkably been observed that in general closely-defined conditions are required for fabric treatment in order to avoid reduction in dyeability of the fabric.

It has been observed that treatment of fibre in the never-dried state according to the invention may give rise to roughnesses in spun yarns prepared from the treated fibre, which may be undesirable in some applications. Treatment of fabric according to the invention does not give rise to surface roughnesses.

In one embodiment of the invention, the crosslinking agent and flexible linear polymer are utilised as separate materials. In another embodiment of the invention, the terminal functional groups in the flexible linear polymer are first reacted with the crosslinking agent to provide a flexible linear polymer having terminal functional groups reactive with cellulose, and never-dried cellulose is subsequently treated with this latter polymer. For example, the crosslinking agent and the flexible linear polymer may react together in solution before application to the fibre.

After treatment with crosslinking agent and flexible linear polymer according to the invention, the fibre is heated to fix and cure the crosslinking agent and is dried. The heating step may precede, be part of or follow the drying step. When the method is applied to never-dried fibre, dry staple fibre may be converted to yarn which is then heated to cure and fix the crosslinking agent. The time and temperature required in the heating step depend on the nature of the crosslinking agent and optional catalyst employed. After heating and drying, the fibre may contain about 0.1 to 4%, preferably 0.5 to 2%, by weight fixed crosslinking agent calculated on weight of cellulose. It has generally been found that about 70 to 75% of the crosslinking agent in the wet fibre may become fixed to the cellulose.

Fibre treated according to the method of the invention may subsequently be dyed with conventional dyes for cellulose fibres.

The method of the invention has the advantage that it may be applied to never-dried fibre, so that protection against fibrillation can be provided at an early stage. Never-dried fibre treated according to the invention exhibits little reduction in dyeability compared with untreated fibre. Fibre treated according to the invention has excellent resistance to fibrillation compared with untreated fibre. Fabric made from never-dried fibre treated according to the method of the invention, for example woven or knitted fabric, can be subjected to severe mechanical treatment in the wet state, such as rope dyeing, without excessive fibrillation. The fabric may be laundered with only little or slow loss of the reduction in fibrillation tendency. The method of the invention generally imparts little if any improvement in crease resistance to fabric made from fibre treated in the never-dried state, and it is remarkable that it nevertheless provides effective protection against fibrillation.

Known methods for the manufacture of solvent-spun cellulose fibre include the steps of:

(i) dissolving cellulose in a solvent to form a solution, the solvent being miscible with water;

(ii) extruding the solution through a die to form a fibre precursor;

(iii) passing the fibre precursor through at least one water bath to remove the solvent and form the fibre; and (iv) drying the fibre.

The wet fibre at the end of step (iii) is never-dried fibre and typically has a water imbibition in the range 120–150% by weight. The dried fibre after step (iv) typically has a water imbibition of around 60–80% by weight. Solvent-spun cellulose never-dried fibre is treated according to the method of the invention before it has been dried, that is to say between steps (iii) and (iv).

The invention is illustrated by the following Examples. In each case, the never-dried fibre used was prepared by extruding a solution of cellulose in N-methylmorpholine N-oxide (NMMO) into an aqueous bath and washing the fibre so formed with water until it was essentially free of NMMO.

Materials were assessed for degree of fibrillation using the method described below as Test Method 1 and assessed for fibrillation tendency using the techniques described below as Test Methods 2A and 2B.

Test Method 1 (Assessment of Fibrillation)

There is no universally accepted standard for assessment of fibrillation, and the following method was used to assess Fibrillation Index (F.I.). Samples of fibre were arranged into a series showing increasing degrees of fibrillation. A standard length of fibre from each sample was then measured and the number of fibrils (fine hairy spurs extending from the main body of the fibre) along the standard length was counted. The length of each fibril was measured, and an arbitrary number, being the product of the number of fibrils multiplied by the average length of each fibril, was determined for each fibre. The fibre exhibiting the highest value of this product was identified as being the most fibrillated fibre and was assigned an arbitrary Fibrillation Index of 10. A wholly unfibrillated fibre was assigned a Fibrillation Index of zero, and the remaining fibres were graded from 0 to 10 based on the microscopically measured arbitrary numbers.

The measured fibres were then used to form a standard graded scale. To determine the Fibrillation Index for any other sample of fibre, five or ten fibres were visually compared under the microscope with the standard graded fibres. The visually determined numbers for each fibre were then averaged to give a Fibrillation Index for the sample under test. It will be appreciated that visual determination and averaging is many times quicker than measurement, and it has been found that skilled fibre technologists are consistent in their rating of fibres.

Fibrillation Index of fabrics can be assessed on fibres drawn from the surface of the fabric. Woven and knitted fabrics having F.I. of more than about 2.0 to 2.5 exhibit an unsightly appearance.

Test Method 2 (Inducement of Fibrillation)

Method 2A (Blender)

0.5 g fibre cut into 5–6 mm lengths and dispersed in 500 ml water at ambient temperature was placed in a household blender (liquidiser) and the blender run for 2 minutes at about 12000 rpm. The fibre was then collected and dried.

Method 2B (Scour Bleach, Dye)

(i) Scour 1 g fibre was placed in a stainless steel cylinder approximately 25 cm long by 4 cm diameter and having a capacity of approximately 250 ml. 50 ml conventional scouring solution containing 2 g/l Detergyl FS955 (an anionic detergent available from ICI plc) (Detergyl is a Trade Mark) and 2 g/l sodium carbonate was added, a screw cap fitted and the capped cylinder tumbled end-over-end at 60 tumbles per minute for 60 minutes at 95° C. The scoured fibre was then rinsed with hot and cold water.

(ii) Bleach 50 ml bleaching solution containing 15 ml/l 35% hydrogen peroxide, 1 g/l sodium hydroxide, 2 g/l Prestogen PC (a bleach stabiliser available from BASF AG) (Prestogen is a Trade Mark) and 0.5 ml/l Irgalon PA (a sequestrant available from Ciba-Geigy AG) (Irgalon is a Trade Mark) was added to the fibre and a screw cap fitted to the cylinder. The cylinder was then tumbled as before for 90 minutes at 95° C. The bleached fibre was then rinsed with hot and cold water.

(iii) Dye 50 ml dyeing solution containing 8% on weight of fibre Procion Navy HER 150 (a reactive dye) (Procion is a Trade Mark of ICI plc) and 55 g/l Glauber's salt was added and the cylinder was capped and tumbled as before for 10 minutes at 40° C. The temperature was raised to 80° C. and sufficient sodium carbonate added to give a concentration of 20 g/l The cylinder was then capped once more and tumbled for 60 minutes. The fibre was rinsed with water. 50 ml solution containing 2 ml/l Sandopur SR (a detergent available from Sandoz AG) (Sandopur is a Trade Mark) was then added and the cylinder capped. The cylinder was then tumbled as before for 20 minutes at 100° C. The dyed fibre was then rinsed and dried.

Method 2A provides more severe fibrillating conditions than Method 2B.

EXAMPLE 1

Never-dried solvent-spun cellulose fibre was immersed in a bath containing varying levels of 1,3-dimethyl-4,5-dihydroxyethyleneurea (available from Hoechst AG under the Trade Mark Arkofix NZF), Catalyst NKD (a magnesium chloride/acetic acid catalyst available from Hoechst AG) (25% by weight on Arkofix NZF), polyethylene glycol (PEG) of various average molecular weights (MW), and DP3408 (a polyether/polyacrylic system available from Precision Processes (Textiles) of Ambergate, Derbyshire). The fibre was then dried at a temperature of 100° C. followed by curing at 170° C. for 20 seconds. The fibre was then assessed for fibrillation tendency by Test Method 2A. Fibrillation Index (F.I.) results are shown below in Table 1A:

TABLE 1A

| Trial | Arkofix NZF g/l | DP3408 g/l | PEG g/l | PEG MW (top row) and FI (body of table) 200 | 300 | 400 | 600 | 1500 | 2000 |
|---|---|---|---|---|---|---|---|---|---|
| 1 | 30 | 5 | 10 | 1.8 | 0.2 | 0.1 | 0.6 | 3.0 | 2.8 |
| 2 | 30 | 10 | 20 | 2.0 | 1. 5 | 0.1 | 1.3 | 1.1 | 2.4 |
| 3 | 30 | 20 | 30 | 3.1 | 1.1 | 0.8 | 0.3 | 2.6 | 2.4 |
| 4 | 50 | 5 | 20 | 0.7 | 2.1 | 1.7 | 1.7 | 0.4 | 3.2 |
| 5 | 50 | 10 | 30 | 0.3 | 1.3 | 1.3 | 1.9 | 1.9 | 2.5 |
| 6 | 50 | 20 | 10 | 1.9 | 1.3 | 0.5 | 1.7 | 3.3 | 2.0 |
| 7 | 50 | 5 | 30 | 1.7 | 0.1 | 0.1 | 1.1 | 0.8 | 0.5 |
| 8 | 80 | 10 | 10 | 0.1 | 1.4 | 0.6 | 2.1 | 0.3 | 1.7 |
| 9 | 80 | 20 | 20 | 1.4 | 0.6 | 0.1 | 0.7 | 1.2 | 2.4 |
| Average | | | | 1.4 | 1.1 | 0.6 | 1.3 | 1.6 | 2.2 |

A control sample of untreated fibre exhibited a Fibrillation Index of 5.0.

Experiments which gave good values of Fibrillation Index at each molecular weight of PEG were repeated, and the results are shown below in Table 1B:

TABLE 1B

| Arkofix NZF g/l | DP3408 g/l | PEG g/l | PEG MW | F.I. |
|---|---|---|---|---|
| 50 | 10 | 10 | 200 | 0.2 |
| 80 | 10 | 30 | 300 | 0.0 |
| 80 | 10 | 30 | 400 | 0.0 |
| 80 | 20 | 10 | 600 | 0.2 |
| 80 | 10 | 20 | 1500 | 3.0 |
| 80 | 5 | 30 | 2000 | 1.8 |

EXAMPLE 2

Never-dried solvent-spun cellulose fibre was immersed in baths containing varying levels of Arkofix NZF, Catalyst NED (25% by weight on Arkofix NZF) and PEG of average molecular weight 300. The fibre was then dried at 100° C. and cured for 20 seconds at 170° C. Fibrillation was induced using Test Method 2A, or 2B, or 2B followed by 2A, and F.I. was assessed using Test Method 1. Results are shown below in Table 2:

TABLE 2

| Arkofix NZF g/l | PEG 300 g/l | Fibrillation Index 2A | 2B | 2B + 2A |
|---|---|---|---|---|
| 50 | 10 | 0.0 | 0.9 | 3.3 |
| 30 | 10 | 0.0 | 1.9 | 3.8 |
| 70 | 30 | 0.6 | 0.4 | 1.6 |
| Control | — | 5.2 | — | — |

EXAMPLE 3

Never-dried solvent-spun cellulose fibre was immersed in a bath containing varying levels of Arkofix NZF, magnesium chloride catalyst (25% by weight on Arkofix NZF) and PEG of average molecular weight 400 (30 g/l). The fibre was then dried at 100° C. and cured for 20 seconds at 170° C. Fibrillation was induced using Test Method 2A, or 2B followed by 2A, and F.I. was assessed using Test Method 1. F.I., tenacity and extensibility results are shown below in Table 3:

TABLE 3

| Arkofix NZF g/l | Fibrillation Index 2A | 2B + 2A | Tenacity cN/tex | Extensibility % |
|---|---|---|---|---|
| 30 | 0.0 | 1.8 | 40.1 | 12.4 |
| 50 | 1.2 | 1.6 | 38.8 | 11.7 |
| 70 | 0.0 | 1.4 | 39.9 | 10.4 |
| 90 | 0.0 | 5.4 | 40.6 | 11.1 |
| 110 | 0.0 | 7.2 | 40.1 | 9.9 |
| Control | 5.2 | — | 41.2 | 12.2 |

EXAMPLE 4

Never-dried solvent-spun cellulose fibre was immersed in baths containing varying levels of Arkofix NZF, Catalyst NKD (25% by weight on Arkofix NZF) and PEG of average molecular weight 300. The fibre was then dried at 100° C. and cured for 20 seconds at 170° C. The fibre was then dyed under standard conditions and its dyeability expressed in terms of its dye uptake as a percentage of the dye uptake of an untreated control sample. The results shown in Table 4 were obtained:

TABLE 4

| Arkofix NZF g/l | PEG 300 g/l | Dyeability % |
|---|---|---|
| 0 | 0 | 100 |
| 70 | 10 | 91.9 |
| 90 | 30 | 90.4 |
| 70 | 0 | 60 |

It will observed that dyeability was very markedly reduced in the comparative experiment in which PEG was omitted.

EXAMPLE 5

Woven fabric of solvent-spun cellulose fibre was padded with solutions containing varying amounts of Arkofix NZF, varying amounts of PEG of varying molecular weights, and magnesium chloride as catalyst (25% by weight on Arkofix NZF). The fabrics were dried at 110° C. and then heated at 160° C. for 30 seconds to cure the resin. The fabrics were dyed with an HE-type reactive dye, and fibrillation was assessed before and after laundering at 60° C. (10 wash/tumble cycles). The results shown in Table 5 were obtained:

TABLE 5

| Arkofix NZF | PEG | | Dyeability | F.I. | |
|---|---|---|---|---|---|
| g/l | M.W. | g/l | % | Unlaundered | Laundered |
| 0 | — | 0 | 100 | 1.8 | 6.4 |
| 70 | 200 | 50 | 83.4 | 0.2 | 2.0 |
| 70 | 200 | 100 | 88.0 | 0.0 | 1.8 |
| 100 | 200 | 50 | 54.8 | 0.0 | 1.0 |
| 100 | 200 | 100 | 85.3 | 0.0 | 1.6 |
| 130 | 200 | 50 | 92.8 | 0.0 | 1.4 |
| 130 | 200 | 100 | 100.1 | 0.0 | 2.0 |
| 70 | 300 | 50 | 68.4 | 0.6 | 2.4 |
| 70 | 300 | 100 | 71.5 | 0.0 | 3.8 |
| 100 | 300 | 50 | 68.0 | 0.0 | 2.0 |
| 100 | 300 | 100 | 97.1 | 0.2 | 1.6 |
| 130 | 300 | 50 | 65.0 | 0.0 | 0.8 |
| 130 | 300 | 100 | 75.7 | 0.2 | 1.0 |
| 70 | 400 | 50 | 85.8 | 0.0 | 2.4 |
| 70 | 400 | 100 | 100.7 | 0.0 | 3.6 |
| 100 | 400 | 50 | 69.3 | 0.0 | 0.8 |
| 100 | 400 | 100 | 85.9 | 0.0 | 0.8 |
| 130 | 400 | 50 | 67.4 | 0.0 | 0.4 |
| 130 | 400 | 100 | 92.3 | 0.0 | 0.4 |
| 70 | 600 | 50 | 40.3 | 0.0 | 3.2 |
| 70 | 600 | 100 | 42.8 | 0.2 | 3.6 |
| 100 | 600 | 50 | 51.3 | 0.0 | 1.2 |
| 100 | 600 | 100 | 72.7 | 0.0 | 1.6 |
| 130 | 600 | 50 | 44.0 | 0.0 | 0.6 |
| 130 | 600 | 100 | 57.6 | 0.0 | 0.4 |

Use of low-formaldehyde resins adversely affected dyeability in comparison with the zero-formaldehyde resin used in the above experiments.

EXAMPLE 6

Never-dried solvent-spun cellulose fibre was treated with an aqueous solution containing Arkofix NZF (40 g./l ), PEG 400 (24 g/l) and magnesium chloride (10 g/l) and dried. The treated fibre was spun into yarn, which was knitted into a fabric. The fabric was heated at 150° C. for 1 minute to cure the resin, dyed and assessed for fibrillation after laundering, with the results shown in Table 6A:

TABLE 6A

| Laundering cycles | F.I. |
|---|---|
| 0 | 2.0 |
| 3 | 1.5 |
| 5 | 2.5 |
| 8 | 3.8 |

The fabric appeared hairy, as did the yarn from which it was made. Fabric hand was very soft even without the use of any softening treatment.

Scoured knitted fabric of solvent-spun cellulose was padded with an aqueous solution containing the zero-formaldehyde resin Quecodur FF (Trade Mark of Thor Chemicals) (160 g/l), PEG 400 (100 g/l) and magnesium chloride (40 g/l). The treated fabric was dried and heated at 150° C. for 1 minute to cure the resin. The fabric was satisfactorily dyed to medium-dark shade with reactive dyes and assessed for fibrillation after laundering, with the results shown in Table 6B:

TABLE 6B

| Laundering cycles | F.I. |
|---|---|
| 0 | 0.4 |
| 3 | 0.8 |
| 5 | 1.3 |
| 8 | 1.1 |

The fabric appeared extremely clean both before and after laundering.

I claim:

1. A method of reducing the fibrillation tendency of solvent-spun cellulose fibre, which comprises contacting said fibre with:

(a) a flexible linear polymer having terminal functional groups; and (b) a crosslinking agent reactive with cellulose and with said terminal functional groups, said flexible linear polymer containing no functional groups reactive with cellulose or with said crosslinking agent other than said terminal functional groups.

2. A method according to claim 1, comprising contacting said fibre with an aqueous solution of the flexible linear polymer and the crosslinking agent.

3. A method according to claim 1, in which the crosslinking agent is a low-formaldehyde or zero-formaldehyde crosslinking agent.

4. A method according to claim 3, comprising contacting said fibre with an acid catalyst for the crosslinking agent.

5. A method according to claim 1, in which the flexible linear polymer is an aliphatic polymer.

6. A method according to claim 5, in which the flexible linear polymer is polyethylene glycol.

7. A method according to claim 1, comprising subsequently heating the fibre to fix and cure the crosslinking agent.

8. A method according to claim 1, comprising subsequently dying the fibre.

9. A method according to claim 1, in which the fibre is never-dried solvent-spun cellulose fibre.

10. A method according to claim 9, in which the flexible linear polymer is polyethylene glycol of average molecular weight in the range 300 to 600.

11. A method according to claim 9 comprising contacting the fibre with an aqueous solution containing 0.5 to 5 percent by weight of the crosslinking agent, expressed on a 100% activity basis.

12. A method according to claim 9 comprising contacting the fibre with an aqueous solution containing 0.5 to 5 percent by weight of the flexible linear polymer.

13. A method according to claim 1, in which the fibre is present in a woven or knitted fabric.

14. A method according to claim 13, in which the flexible linear polymer is polyethylene glycol of average molecular weight in the range 300 to 400.

15. A method according to claim 14, comprising contacting the fabric with an aqueous solution containing 10 to 15 percent by weight of the polyethylene glycol.

16. A method according to claim 13, in which the crosslinking agent is a zero-formaldehyde resin.

17. A method according to claim 13 comprising contacting the fabric with an aqueous solution containing 5 to 7.5 percent by weight of the crosslinking agent, expressed on a 100% activity basis.

* * * * *